US011348544B1

(12) United States Patent
Zhang et al.

(10) Patent No.: US 11,348,544 B1
(45) Date of Patent: May 31, 2022

(54) ELECTRONIC PAPER DISPLAY APPARATUS AND DRIVING METHOD THEREOF

(71) Applicants: Chongqing BOE Smart Electronics System Co., Ltd., Chongqing (CN); BOE Technology Group Co., Ltd., Beijing (CN)

(72) Inventors: Shengbo Zhang, Beijing (CN); Qiangeng Cheng, Beijing (CN); Lichun Chen, Beijing (CN); Yong Peng, Beijing (CN)

(73) Assignees: Chongqing BOE Smart Electronics System Co., Ltd., Chongqing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/342,570

(22) Filed: Jun. 9, 2021

(30) Foreign Application Priority Data

Nov. 26, 2020 (CN) ..... 202011344707.6

(51) Int. Cl.
*G09G 3/34* (2006.01)
*G09G 3/00* (2006.01)

(52) U.S. Cl.
CPC ..... *G09G 3/3453* (2013.01); *G09G 3/035* (2020.08); *G09G 2330/021* (2013.01)

(58) Field of Classification Search
CPC ..... G09G 3/3453; G09G 3/035; G09G 2330/021; G09G 3/344; G09G 3/34; G09G 5/14; G09G 3/2074
See application file for complete search history.

(56) References Cited

U.S. PATENT DOCUMENTS

2002/0196207 A1* 12/2002 Machida ..... G09G 3/34 345/55
2003/0137521 A1* 7/2003 Zehner ..... G09G 3/344 345/589
2006/0170648 A1* 8/2006 Zhou ..... G09G 3/344 345/107
2006/0262081 A1* 11/2006 Zhou ..... G09G 3/344 345/107
2007/0018944 A1* 1/2007 Johnson ..... G09G 3/344 345/107

(Continued)

*Primary Examiner* — Richard J Hong
(74) *Attorney, Agent, or Firm* — Ling Wu; Stephen Yang; Ling and Yang Intellectual Property

(57) ABSTRACT

Provided is a method for driving an electronic paper display apparatus, including: applying a first driving signal to a first electrode of a microcapsule to be displayed in white, and applying a second driving signal to a first electrode of a microcapsule to be displayed in black according to a black-and-white particle image to be displayed. The first driving signal includes a first sub-driving signal applied in a display stage, wherein the first sub-driving signal is configured to drive the white particles in the microcapsule to be displayed in white to be closer to a display side relative to the black particles. The second driving signal includes a second sub-driving signal applied in the display stage, wherein the second sub-driving signal is configured to drive the black particles in the microcapsule to be displayed in black to be closer to the display side relative to the white particles.

16 Claims, 3 Drawing Sheets

(56) References Cited

U.S. PATENT DOCUMENTS

| | | | | |
|---|---|---|---|---|
| 2007/0080926 | A1* | 4/2007 | Zhou | G09G 3/344 345/107 |
| 2007/0080927 | A1* | 4/2007 | Zhou | G09G 3/344 345/107 |
| 2007/0091117 | A1* | 4/2007 | Zhou | G09G 3/344 345/619 |
| 2007/0164982 | A1* | 7/2007 | Zhou | G09G 3/344 345/107 |
| 2007/0206262 | A1* | 9/2007 | Zhou | G09G 5/14 359/267 |
| 2011/0001764 | A1* | 1/2011 | Rhodes | G09G 3/344 345/690 |
| 2012/0262496 | A1* | 10/2012 | Swic | G09G 3/344 345/690 |
| 2020/0026143 | A1* | 1/2020 | Lin | G09G 3/2074 |

* cited by examiner

ELECTRONIC PAPER DISPLAY APPARATUS AND DRIVING METHOD THEREOF

CROSS-REFERENCE TO RELATED APPLICATION

The present application claims priority of Chinese Patent Application No. 202011344707.6 filed to the CNIPA on Nov. 26, 2020, the content of which is hereby incorporated by reference.

TECHNICAL FIELD

The present disclosure relates to, but is not limited to, the field of display technology, in particular to an electronic paper display apparatus, and a method for driving the electronic paper display apparatus.

BACKGROUND

Electronic paper (E-paper, also called as electronic ink) display apparatus has advantages of eye protection and power saving, which has drawn wide attention. An electronic paper display apparatus includes multiple microcapsules, and electrically charged black particles and white particles are encapsulated in each microcapsule. Gray tone display of the electronic paper display apparatus depends on distribution of the black particles and the white particles in the microcapsules, while the distribution of the black particles and the white particles depends on the applied voltage sequence, which is, a driving waveform. Thus, optimization of the driving waveform directly affects the display effect of the electronic paper display apparatus.

SUMMARY

The following is a summary of subject matter described in detail herein. This summary is not intended to limit the protection scope of the claims.

Embodiments of the present disclosure provide an electronic paper display apparatus, and a method for driving the electronic paper display apparatus.

In one aspect, an embodiment of the present disclosure provides a method for driving an electronic paper display apparatus. The electronic paper display apparatus includes multiple microcapsules, and a first electrode and a second electrode disposed on opposite sides of at least one of the microcapsules; the at least one microcapsule includes black particles and white particles, wherein an electric property of charges carried by the black particles and an electric property of charges carried by the white particles are opposite. The driving method includes: applying a first driving signal to a first electrode of a microcapsule to be displayed in white, and applying a second driving signal to a first electrode of a microcapsule to be displayed in black according to a black-and-white particle image to be displayed. The first driving signal includes a first sub-driving signal applied in a display stage, wherein the first sub-driving signal is configured to drive the white particles in the microcapsule to be displayed in white to be closer to a display side relative to the black particles. The second driving signal includes a second sub-driving signal applied in the display stage, wherein the second sub-driving signal is configured to drive the black particles in the microcapsule to be displayed in black to be closer to the display side relative to the white particles. An effective voltage of the first sub-driving signal and an effective voltage of the second sub-driving signal are alternately applied in sequence.

In some exemplary embodiments, the effective voltage of the first sub-driving signal and the effective voltage of the second sub-driving signal have a same absolute value and opposite electrical properties.

In some exemplary embodiments, the first sub-driving signal includes at least one first pulse unit, and the second sub-driving signal includes at least one second pulse unit. The at least one first pulse unit and the at least one second pulse unit are in one-to-one correspondence.

In some exemplary embodiments, each first pulse unit includes a first voltage and a first common voltage which are sequentially applied; each second pulse unit includes a second voltage and a second common voltage which are sequentially applied; and the first voltage and the second voltage have opposite electrical properties. The first voltage is equal to the effective voltage of the first sub-driving signal, and the second voltage is equal to the effective voltage of the second sub-driving signal. The first voltage has same application duration of as the second common voltage, and the first common voltage has same application duration as the second voltage.

In some exemplary embodiments, the first voltage has a same application duration as the second voltage.

In some exemplary embodiments, the first sub-driving signal includes N first pulse units, and the second sub-driving signal includes N second pulse units, wherein N is an integer greater than 1. An end moment of a first voltage of a n-th first pulse unit is a start moment of a second voltage of a corresponding n-th second pulse unit, and an end moment of the second voltage of the n-th second pulse unit is a start moment of a first voltage of a (n+1)-th first pulse unit, wherein n is an integer greater than 0 and less than N.

In some exemplary embodiments, the first driving signal further includes a third sub-driving signal applied in a balance stage before the display stage; and the second driving signal further includes a fourth sub-driving signal applied in the balance stage before the display stage. A product of an absolute value of the effective voltage of the third sub-driving signal and an application duration thereof is equal to a product of an absolute value of the effective voltage of the fourth sub-driving signal and an application duration thereof. The effective voltage of the third sub-driving signal and the effective voltage of the fourth sub-driving signal have the same absolute value and opposite electrical properties.

In some exemplary embodiments, the effective voltage of the third sub-driving signal and the effective voltage of the first sub-driving signal have opposite electrical properties. The effective voltage of the fourth sub-driving signal and the effective voltage of the second sub-driving signal have opposite electrical properties.

In some exemplary embodiments, the first driving signal further includes a fifth sub-driving signal applied in a shaking stage between the display stage and the balance stage. The second driving signal further includes a sixth sub-driving signal applied in the shaking stage between the display stage and the balance stage. The fifth sub-driving signal and the sixth sub-driving signal each include pulse signals with alternating positive and negative voltages.

In some exemplary embodiments, absolute values of effective voltages of the first sub-driving signal, the second sub-driving signal, the third sub-driving signal, the fourth sub-driving signal, the fifth sub-driving signal and the sixth sub-driving signal are all the same.

In another aspect, an embodiment of the present disclosure further provides an electronic paper display apparatus, which includes: multiple microcapsules, and a first electrode and a second electrode disposed on opposite sides of at least one of the microcapsule; the at least one microcapsule includes black particles and white particles, wherein an electric property of charges carried by the black particles and an electric property of charges carried by the white particles are opposite. The electronic paper display apparatus further includes a processor, which is configured to execute any one of the aforementioned driving method.

In another aspect, an embodiment of the present disclosure provides a non-transitory computer readable storage medium storing a computer program that implements any one of the aforementioned driving methods when the computer program is executed by a processor.

Other aspects will be understood after the drawings and the detailed description are read and understood.

BRIEF DESCRIPTION OF DRAWINGS

Accompanying drawings are used to provide a further understanding of technical solutions of the present disclosure and constitute a part of the description. They are used for explaining the technical solutions of the present disclosure together with embodiments of the present application and do not constitute a limitation on the technical solutions of the present disclosure. Shapes and sizes of one or more components in the accompanying drawings do not reflect real scales, and are only for a purpose of schematically illustrating contents of the present disclosure.

DETAILED DESCRIPTION

Figure 1:
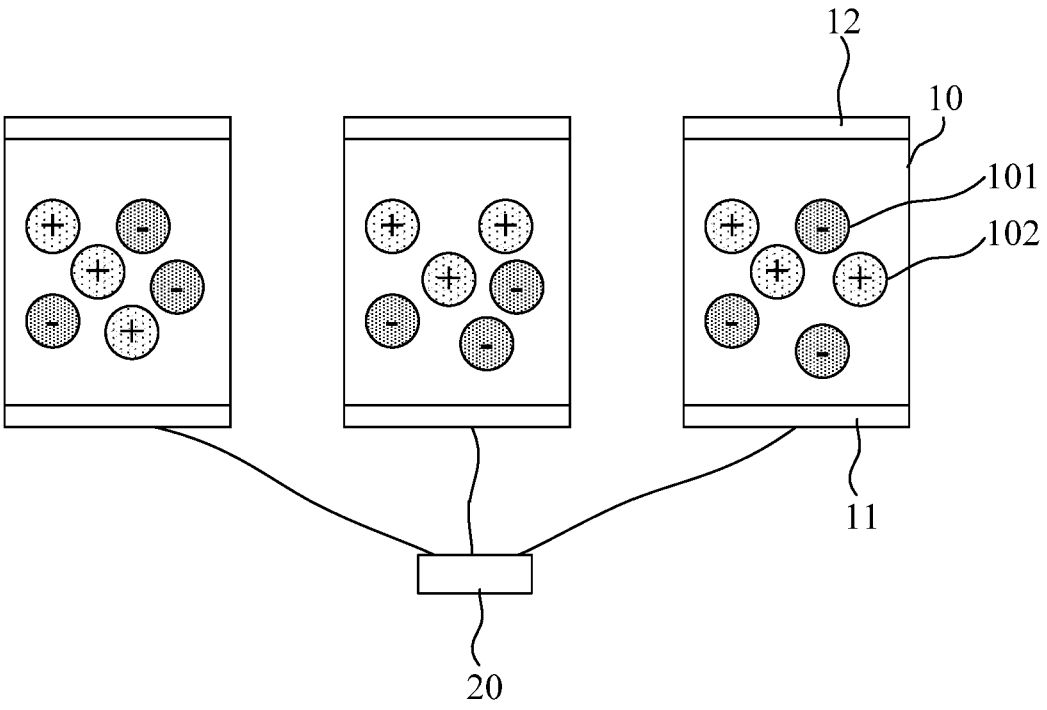
FIG. 1 is a schematic diagram of an electronic paper display apparatus according to at least one embodiment of the present disclosure.

Multiple embodiments are described in the present disclosure, but the description is exemplary rather than restrictive, and it is apparent to those of ordinary skills in the art that there may be more embodiments and implementation solutions within the scope of the embodiments described in the present disclosure. Although many possible combinations of features are shown in the drawings and discussed in the embodiments, many other combinations of the disclosed features are also possible. Unless specifically limited, any feature or element of any embodiment may be used in combination with or in place of any other feature or element of any other embodiment.

The present disclosure includes and contemplates combinations of features and elements known to those of ordinary skilled in the art. The disclosed embodiments, features and elements of the present disclosure may be combined with any conventional features or elements to form a unique inventive scheme defined by the claims. Any feature or element of any embodiment may also be combined with features or elements from other inventive solutions to form another unique inventive solution defined by the claims. Therefore, it should be understood that any of the features shown and discussed in the present disclosure may be implemented individually or in any suitable combination. Therefore, the embodiments are not otherwise limited except in accordance with the appended claims and equivalents thereof. In addition, various modifications and changes may be made within the protection scope of the appended claims.

Furthermore, when describing representative embodiments, the specification may have presented a method or process as a specific sequence of steps. However, to the extent that the method or the process does not depend on the specific order of steps described herein, the method or process should not be limited to the specific order of steps described. As those of ordinary skills in the art will understand, other orders of steps are also possible. Therefore, the specific order of steps set forth in the specification should not be interpreted as limiting the claims. Furthermore, the claims for the method or the process should not be limited to performing the steps in the order of its steps and those skilled in the art can easily understand that these orders may be varied but still remain within the essence and scope of the embodiments of the present disclosure.

The "first", "second", "third" and other ordinal numbers in the present disclosure are used to avoid confusion of constituent elements, not to provide any quantitative limitation. In the description of the present disclosure, "multiple" means two or more counts.

In the present disclosure, for the sake of convenience, wordings such as "central", "upper", "lower", "front", "rear", "vertical", "horizontal", "top", "bottom", "inner", "outer" and the others describing the orientations or positional relations are used to depict relations of elements with reference to the drawings, which are only for an easy and simplified description of the present disclosure, rather than for indicating or implying that the device or element referred to must have a specific orientation, or must be constructed and operated in a particular orientation and therefore, those wordings cannot be construed as limitations on the present disclosure. The positional relations of the constituent elements may be appropriately changed according to the direction in which constituent elements are described. Therefore, they are not limited to the wordings in the specification, and may be replaced appropriately according to the situations.

In the present disclosure, the terms "install", "connect" and "couple" shall be understood in their broadest sense unless otherwise explicitly specified and defined. For example, a connection may be a fixed connection, or may be a detachable connection, or an integrated connection; it may be a mechanical connection, or may be an electrical connection; it may be a direct connection, or may be an indirect connection through middleware, or may be an internal connection between two elements. Those of ordinary skills in the art can understand the specific meanings of the above terms in the present disclosure according to situations.

For a current available electronic paper display apparatus, whitening of image tend to occur when displaying a black-and-white particle image, especially for a large-sized electronic paper display apparatus. Since black particles and white particles in a microcapsule have opposite electrical properties, in a display stage of the black-and-white particle image, it takes a lot of energy to simultaneously drive the white particles in microcapsules to be displayed to be closer to the display side relative to the black particles and to drive the black particles in microcapsules to be displayed to be closer to the display side relative to the white particles. When the drive capacity of the electronic paper display apparatus is insufficient, whitening of display tends to occur, affecting the user experience.

At least one embodiment of the present disclosure provides an electronic paper display apparatus and method for driving the electronic paper display apparatus, which can effectively improve the problem of whitening of display of black-and-white particle images, and further improve the display effect.

At least one embodiment of the present disclosure provides an electronic paper display apparatus including multiple microcapsules, and a first electrode and a second electrode disposed on opposite sides of at least one of the microcapsule. At least one microcapsule includes black particles and white particles, wherein electric properties of charges carried by the black particles and electric properties of charges carried by the white particles are opposite. The electronic paper display apparatus further includes a processor. The processor is configured to apply a first driving signal to a first electrode of a microcapsule to be displayed in white, and apply a second driving signal to a first electrode of a microcapsule to be displayed in black according to a black-and-white particle image to be displayed. The first driving signal includes a first sub-driving signal applied in a display stage, wherein the first sub-driving signal is configured to drive the white particles in the microcapsule to be displayed in white to be closer to a display side relative to the black particles. The second driving signal includes: a second sub-driving signal applied in the display stage, wherein the second sub-driving signal is configured to drive the black particles in the microcapsule to be displayed in black to be closer to the display side relative to the white particles. An effective voltage of the first sub-driving signal and an effective voltage of the second sub-driving signal are alternately applied in sequence.

The electronic paper display apparatus provided by the present exemplary embodiment is a black-and-white electronic paper display apparatus, wherein the black particles and the white particles encapsulated in the microcapsules keep moving under the action of an electric field generated between the first electrode and the second electrode. When white particles in a microcapsule are closer to the display side relative to black particles under the action of electric field, the ambient light will be completely reflected when irradiating on the display side and showing white. When the black particles in the microcapsule are closer to the display side relative to the white particles under the action of the electric field, the ambient light will be totally absorbed when irradiating on the display side, showing black, thus forming black-and-white display. When the black particles and the white particles in the microcapsule are mixed in proportion on the display side under the action of the electric field, colors with different gray levels can be formed on the display side. When the applied electric field is cancelled, the black particles and white particles in the microcapsule stay in their original positions, maintaining the imaging display.

In the electronic paper display apparatus provided by the present exemplary embodiment, the effective voltage of the first sub-driving signal and the effective voltage of the second sub-driving signal are alternately applied in sequence according to the black-and-white particle image to be displayed, which can alternately drive movement of the white particles in the microcapsules to be displayed in white and movement of the black particles in the microcapsules to be displayed in black in a display stage. In some examples, in the display stage, the white particles in the microcapsules to be displayed in white may be firstly driven to be closer to the display side relative to the black particles, and then the black particles in the microcapsules to be displayed in black may be driven to be closer to the display side relative to the white particles. Or, in the display stage, the black particles in the microcapsules to be displayed black are firstly driven to be closer to the display side relative to the white particles, and then the white particles in the microcapsules to be displayed white are driven to be closer to the display side relative to the black particles. However, this is not limited in the present embodiment.

The electronic paper display apparatus and a method for driving the electronic paper display apparatus according to the present embodiment will be illustrated by some examples below.

FIG. 1 is a schematic diagram of an electronic paper display apparatus according to at least one embodiment of the present disclosure. The electronic paper display apparatus according to the present exemplary embodiment is a black-and-white electronic paper display apparatus, In some exemplary embodiments, as shown in FIG. 1, the electronic paper display apparatus of the present exemplary embodiment includes multiple microcapsules 10, and a first electrode 11 and a second electrode 12 disposed on opposite sides of at least one microcapsule 10. At least one microcapsule 10 includes black particles 102 and white particles 101. The black particles 102 and the white particles 101 have opposite electrical properties. In some examples, the black particles 102 are positively charged and the white particles 101 are negatively charged. However, this is not limited in the present embodiment. For example, the black particles may be negatively charged and the white particles may be positively charged.

In some exemplary embodiments, as shown in FIG. 1, the electronic paper display apparatus further includes a processor 20. The processor 20 may provide driving signals to the first electrode 11 and the second electrode 12 to control the electric field generated by the first electrode 11 and the second electrode 12, thereby controlling the movement of charged particles in the microcapsule 10. For example, the processor may include a sequence control chip and a circuit structure that provides driving signals to the first electrode and the second electrode. However, this is not limited in the present embodiment.

In some exemplary embodiments, as shown in FIG. 1, the second electrode 12 is closer to the display side than the first electrode 11, that is, a second substrate side where the second electrode 12 is located is the display side. However, this is not limited in the present embodiment. In some examples, the first electrode may be closer to the display side than the second electrode, that is, a first substrate side where the first electrode is located may be the display side.

In some exemplary embodiments, second electrodes 12 corresponding to multiple microcapsules 10 may be electrically connected together. For example, the second electrodes corresponding to the multiple microcapsules may have an integrated structure. Voltage signals applied by the multiple second electrodes are the same, and the second electrodes may be called a common electrode (or Vcom electrodes), and the voltage applied to the second electrodes may be called a common voltage (or Vcom). However, this is not limited in the present embodiment. For example, the second electrodes corresponding to the multiple microcapsules may not be electrically connected together, and the voltage signals applied by the second electrodes may be either same or different. In some examples, the second electrodes may be grounded (i.e., the common voltage is 0V).

Figure 2:
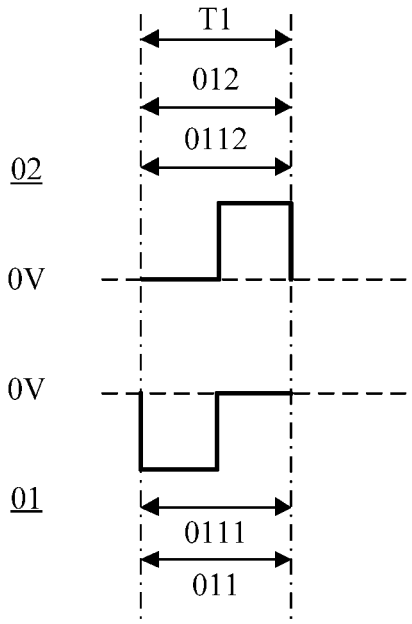
FIG. 2 is a sequence chart of a display stage of a method for driving an electronic paper display apparatus according to at least one embodiment of the present disclosure.

FIG. 2 is a sequence chart of a display stage of a method for driving an electronic paper display apparatus according to at least one embodiment of the present disclosure. In some exemplary embodiments, as shown in FIG. 2, a first driving signal 01 applied to a first electrode of a microcapsule to be displayed in white includes a first sub-driving signal 011 in a display stage T1. A second driving signal 02 applied to a first electrode of a microcapsule to be displayed in black includes a second sub-driving signal 012 in the display stage T1.

In some examples, in the display stage T1, the first sub-driving signal 011 is applied to the first electrode of the microcapsule to be display in white, so that the first electrode and a second electrode generate an electric field which drives the white particles in the microcapsule to move towards the side of the second electrode, so that the microcapsule is displayed in white near the display side. Since the white particles are negatively charged, the first sub-driving signal 011 applied to the first electrode is a negative voltage signal. An effective voltage of the first sub-driving signal 011 is a negative voltage, and the voltage value should be sufficient to drive the white particles to move.

In some examples, in the display stage T1, the second sub-driving signal 012 is applied to a first electrode of a microcapsule to be displayed in black, so that the first electrode and a second electrode generate an electric field to drive the black particles in the microcapsule to move towards the side of the second electrode, so that the microcapsule is displayed in black near the display side. Since the black particles are positively charged, the second sub-driving signal 012 applied to the first electrode is a positive voltage signal. An effective voltage of the second sub-driving signal 012 is a positive voltage, and the voltage value should be sufficient to drive the black particles to move.

In some examples, as shown in FIG. 2, the first sub-driving signal 011 includes a first pulse unit 0111, and the second sub-driving signal 012 includes a second pulse unit 0112. The first pulse unit 0111 corresponds to the second pulse unit 0112. The first pulse unit 0111 includes a first voltage and a first common voltage which are sequentially applied, and the second pulse unit 0112 includes a second common voltage and a second voltage which are sequentially applied, wherein the first voltage and the second voltage have opposite electrical properties. In this example, the first voltage of the first pulse unit 0111 is a negative voltage, and the second voltage of the second pulse unit 0112 is a positive voltage. An absolute value of the first voltage of the first pulse unit 0111 and that of the second voltage of the second pulse unit 0112 are the same. For example, the first voltage is −15V and the second voltage is +15V. The first common voltage and the second common voltage are both 0V. However, this is not limited in the present embodiment.

In some examples, as shown in FIG. 2, an application duration of the first voltage of the first pulse unit 0111 is the same as an application duration of the second common voltage of the second pulse unit 0112, and an application duration of the first common voltage of the first pulse unit 0111 is the same as an application duration of the second voltage of the second pulse unit 0112. For example, the application durations of the first voltage of the first pulse unit 0111, the second voltage of the second pulse unit 0112, the first common voltage of the first pulse unit 0111 and the second common voltage of the second pulse unit 0112 are all the same. However, this is not limited in the present embodiment. In some examples, the application duration of the first voltage of the first pulse unit is the same as the application duration of the second common voltage of the second pulse unit, and is greater than the application duration the second voltage of the second pulse unit. The application duration of the second voltage of the second pulse unit is the same as the application duration of the first common voltage of the first pulse unit. Or, the application duration of the first voltage of the first pulse unit is the same as the application duration of the second common voltage of the second pulse unit, and is less than the application duration the second voltage of the second pulse unit. The application duration of the second voltage of the second pulse unit is the same as the application duration of the first common voltage of the first pulse unit.

In some examples, as shown in FIG. 2, an end moment of the first voltage of the first pulse unit 0111 is a start moment of the second voltage of the second pulse unit 0112. In other words, driving a black part after driving a white part of the black-and-white particle image to be displayed can effectively increase the refresh frequency. However, this is not limited in the present embodiment. For example, there may be a certain interval between the end moment of the first voltage of the first pulse unit and the start moment of the second voltage of the second pulse unit, and both the first pulse unit and the second pulse unit include a zero voltage applied during this period of time.

In some examples, as shown in FIG. 2, an application period of the effective voltage of the first sub-driving signal 011 is an application period of the first voltage of the first pulse unit 0111, and an application period of the effective voltage of the second sub-driving signal 012 is an application period of the second voltage of the second pulse unit 0112. It can be seen that the effective voltage of the first sub-driving signal 011 and the effective voltage of the second sub-driving signal 012 are alternately applied in sequence, instead of being applied at the same time. In this example, an end moment of the effective voltage of the first sub-driving signal 011 is a start moment of the effective voltage of the second sub-driving signal 012. However, this is not limited in the present embodiment. For example, a start moment of the effective voltage of the first sub-driving signal is an end moment of the effective voltage of the second sub-driving signal.

In the present exemplary embodiment, according to the black-and-white particle image to be displayed, the first sub-driving signal is applied to the first electrode of the microcapsule to be display in white and the second sub-driving signal is applied to the first electrode of microcapsules to be displayed in black in the display stage T1, and the effective voltages of the first sub-driving signal and the second sub-driving signal are alternately applied in sequence. For example, in the display stage, the white particles in the microcapsule to be displayed in white are firstly driven to be closer to the display side relative to black particles, and then the black particles in the microcapsule to be displayed in black may be driven to be closer to the display side relative to the white particles. Or, the black particles in the microcapsule to be displayed in black are firstly driven to be closer to the display side relative to the white particles, and then the white particles in the microcapsule to be displayed in white are driven to be closer to the display side relative to the black particles. The driving method of the present exemplary embodiment can effectively improve the problem of whitening of display of black-and-white particle images, and further improve the display effect.

Figure 3:
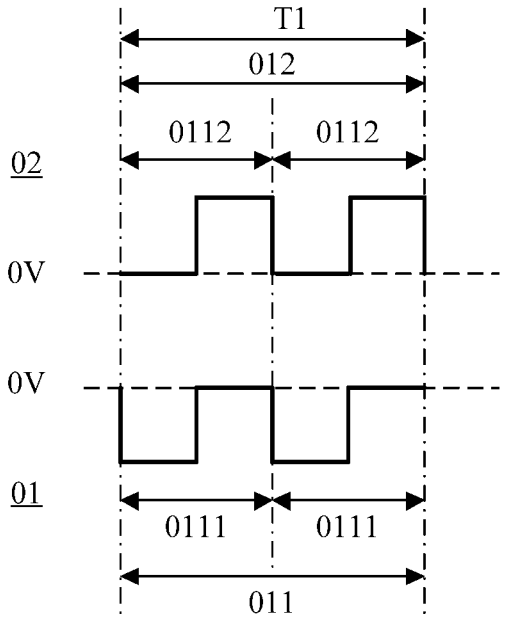
FIG. 3 is another sequence chart of a display stage of a method for driving an electronic paper display apparatus according to at least one embodiment of the present disclosure.

FIG. 3 is another sequence chart of a display stage of a method for driving an electronic paper display apparatus according to at least one embodiment of the present disclosure. In some exemplary embodiments, as shown in FIG. 3, a first driving signal 01 applied to a first electrode of a microcapsule to be displayed in white includes a first sub-driving signal 011 in a display stage T1. A second driving signal 02 applied to a first electrode of a microcapsule to be displayed in black includes a second sub-driving signal 012 in the display stage T1. The first sub-driving signal 011 includes two first pulse units 0111, and the second sub-driving signal 012 includes two second pulse units 0112. The two first pulse units 0111 corresponds to the two second pulse units 0112 in one-to-one correspondence. Each first pulse unit 0111 includes a first voltage and a first common voltage which are sequentially applied, and each second pulse unit 0112 includes a second common voltage and a second voltage which are sequentially applied, wherein the first voltage and the second voltage have opposite electrical properties. In this example, the first voltage of the first pulse unit 0111 is a negative voltage, and the second voltage of the second pulse unit 0112 is a positive voltage. The absolute values of the first voltage of the first pulse unit 0111 and the second voltage of the second pulse unit 0112 are the same. For example, the first voltage is −15V and the second voltage is +15V. The first common voltage and the second common voltage are both 0V. However, this is not limited in the present embodiment.

In some examples, as shown in FIG. 3, application durations of the first voltages of the two first pulse units 011 are the same, and application durations of the first common voltages of the two first pulse units 011 are the same. Application durations of the second voltages of the two second pulse units 012 are the same, and application durations of the second common voltages of the two second pulse units 012 are the same. However, this is not limited in the present embodiment. For example, application durations of the first voltages and the first common voltages in the multiple first pulse units may be gradually reduced in the order in which the multiple first pulse units are sequentially applied. Application durations of the second common voltages and the second voltages in the multiple second pulse units may be gradually reduced in the order in which the multiple second pulse units are sequentially applied.

In some examples, as shown in FIG. 3, the application duration of the first voltages of the two first pulse units 0111 is the same as that of the second common voltages of the two second pulse units 0112, and the application duration of the first common voltages of the two first pulse units 0111 is the same as that of the second voltages of the two second pulse units 0112. For example, the application durations of the first voltages of the two first pulse units 0111, the second voltages of the two second pulse units 0112, the first common voltages of the two first pulse units 0111 and the second common voltages of the two second pulse units 0112 are all the same. However, this is not limited in the present embodiment.

In some examples, as shown in FIG. 3, an end moment of the first voltage of the first one of the first pulse units 0111 is a start moment of the second voltage of a corresponding first second pulse unit 0112. An end moment of the second voltage of the first second pulse unit 0112 is a start moment of the first voltage of the second first pulse unit 0111. An end moment of the first voltage of the second first pulse unit 0111 is a start moment of the second voltage of the second one of the second pulse units 0112. An application duration of the effective voltage of the first sub-driving signal 011 is a sum of the application durations of the first voltages of the two first pulse units 0111, and an application duration of the effective voltage of the second sub-driving signal 012 is a sum of the application durations of the second voltages of the two second pulse units 0112. The effective voltage of the first sub-driving signal 011 and the effective voltage of the second sub-driving signal 012 are alternately applied in sequence, instead of being applied at the same time.

In this example, in a process of applying the first voltage, the white particles in microcapsules will move to the display side, so the first common voltage (i.e. zero voltage for a period of time) is applied after the first voltage is applied, and the white particles will move to the display side for a period of time due to inertia. In this way, the white particles can be more easily moved to the display side, improving the white display effect. In a process of applying the second voltage, the black particles in microcapsules will move to the display side, so the second common voltage (i.e. zero voltage for a period of time) is applied after the second voltage is applied, and the black particles will move to the display side for a period of time due to inertia. In this way, the black particles can be more easily moved to the display side, improving the black display effect.

In this example, when displaying the black-and-white particle image to be displayed, the white particles in the microcapsules to be displayed in white are driven twice and the black particles in the microcapsules to be displayed in black are driven twice, and the white particles and the black particles are driven alternately in turn, which can effectively improve the display effect.

Other implementations of the driving method according to the present exemplary embodiment may be referred to the description of the previous embodiment and will not be repeated here.

Figure 4:
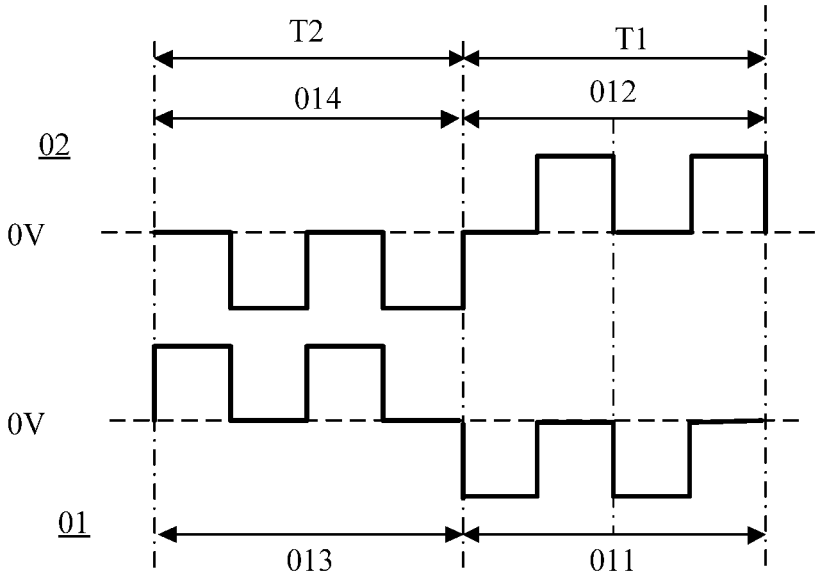
FIG. 4 is a sequence chart of a balance stage and a display stage of a method for driving an electronic paper display apparatus according to at least one embodiment of the present disclosure.

FIG. 4 is a sequence chart of a balance stage and a display stage of a method for driving an electronic paper display apparatus according to at least one embodiment of the present disclosure. In some exemplary embodiments, as shown in FIG. 4, a method for driving an electronic paper display apparatus includes a balance stage T2 before a display stage T1, and the display stage T1. A first driving signal 01 includes a third sub-driving signal 013 applied to a first electrode of a microcapsule to be displayed in white in the balance stage T2 before the display stage T1, and a first sub-driving signal 011 applied in the display stage T1. A second driving signal 02 includes a fourth sub-driving signal 014 applied to a first electrode of a microcapsule to be displayed in black in the balance stage T2 before the display stage T1, and a second sub-driving signal 012 applied in the display stage T1. A product of an absolute value of an effective voltage of the third sub-driving signal 013 and the application duration is equal to a product of an absolute value of an effective voltage of the fourth sub-driving signal 014 and the application duration. The effective voltage of the third sub-driving signal 013 and the effective voltage of the fourth sub-driving signal 014 have a same absolute value and opposite electrical properties.

In some examples, as shown in FIG. 4, the effective voltage of the third sub-driving signal 013 and the effective voltage of the first sub-driving signal 011 have opposite electrical properties. The effective voltage of the fourth sub-driving signal 014 and the effective voltage of the second sub-driving signal 012 have opposite electrical properties. For example, the effective voltage of the first sub-driving signal 011 is negative, and the effective voltage of the third sub-driving signal 013 is positive. The effective voltage of the second sub-driving signal 012 is positive, and the effective voltage of the fourth sub-driving signal 014 is negative. However, this is not limited in the present embodiment.

In some examples, as shown in FIG. 4, the effective voltage of the third sub-driving signal 013 and the effective voltage of the first sub-driving signal 011 have a same absolute value. The effective voltage of the fourth sub-driving signal 014 and the effective voltage of the second sub-driving signal 012 have the same absolute value. For example, the effective voltages of the third sub-driving signal 013 and the second sub-driving signal 012 are +15V, and the effective voltages of the first sub-driving signal 011 and the fourth sub-driving signal 014 are −15V. However, this is not limited in the present embodiment.

In some examples, as shown in FIG. 4, an application duration of the effective voltage of the third sub-driving signal 013 is the same as an application duration of the effective voltage of the fourth sub-driving signal. The application duration of the effective voltage of the third sub-driving signal 013 is equal to a product of the number of application times and per-time application duration of the effective voltage of the third sub-driving signal 013. The application duration of the effective voltage of the fourth sub-driving signal 014 is equal to a product of the number of application times and per-time application duration of the effective voltage of the fourth sub-driving signal 014. The per-time application duration of the effective voltage of the third sub-driving signal 013 is the same as that of the fourth sub-driving signal 014. The number of application times of the effective voltage of the third sub-driving signal 013 is the same as that of the fourth sub-driving signal 014. For example, the number of application times of the effective voltage of the third sub-driving signal 013 and the number of application times of the effective voltage of the fourth sub-driving signal 014 are both 2. However, this is not limited in the present embodiment.

In some examples, as shown in FIG. 4, the third sub-driving signal 013 includes a positive voltage, a zero voltage, a positive voltage and a zero voltage which are sequentially applied. The fourth sub-driving signal 014 includes a zero voltage, a negative voltage, a zero voltage and a negative voltage which are sequentially applied. An application duration of the positive voltages of the third sub-driving signal 013 is the same as an application duration of the zero voltages of the fourth sub-driving signal 014, and an application duration of the zero voltages of the third sub-driving signal 013 is the same as an application duration of the negative voltages of the fourth sub-driving signal 014. The application durations of the two positive voltages and the two zero voltages of the third sub-driving signal 013 are the same, and the application durations of the two negative voltages and the two zero voltages of the fourth sub-driving signal 014 are the same. An application duration of the positive voltages of the third sub-driving signal 013 may be the same as the application duration of the first voltages of the first sub-driving signal 011, and an application duration of the negative voltages of the fourth sub-driving signal 014 may be the same as the application duration of the second voltages of the second sub-driving signal 012. In the present exemplary embodiment, particle polarization can be avoided through the driving waveform in a balance stage.

The implementation of the driving waveform in a display stage in the present exemplary embodiment may be referred to the description of the corresponding embodiment in FIG. 3, and will not be repeated here.

Figure 5:
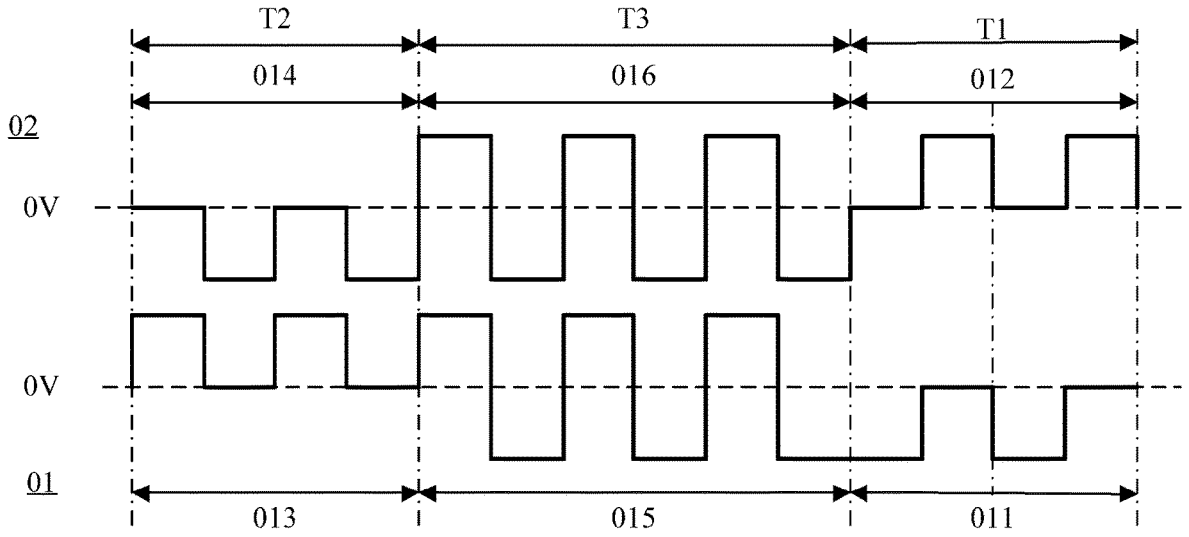
FIG. 5 is a sequence chart of a balance stage, a shaking stage and a display stage of a method for driving an electronic paper display apparatus according to at least one embodiment of the present disclosure.

FIG. 5 is a sequence chart of a balance stage, a shaking stage and a display stage of a method for driving an electronic paper display apparatus according to at least one embodiment of the present disclosure. In some exemplary embodiments, as shown in FIG. 5, the method for driving an electronic paper display apparatus includes a balance stage T2, a display stage T1, and a shaking stage T3 between the display stage T1 and the balance stage T2. A first driving signal 01 includes a third sub-driving signal 013 applied in the balance stage T2, a fifth sub-driving signal 015 applied to a first electrode of a microcapsule to be displayed in white in the shaking stage T3 between the display stage T1 and the balance stage T2, and a first sub-driving signal 011 applied in the display stage T1. A second driving signal 02 includes a fourth sub-driving signal 014 applied in the balance stage T2, a sixth sub-driving signal 016 applied to a first electrode of a microcapsule to be displayed in black in the shaking stage T3 between the display stage T1 and the balance stage T2, and a second sub-driving signal 012 applied in the display stage T1. The fifth sub-driving signal 015 and the sixth sub-driving signal 016 each include pulse signals with alternating positive and negative voltages. As shown in FIG. 5, the fifth sub-driving signal 015 and the sixth sub-driving signal 016 each include three pulse signals. However, the number of pulse signals included in the fifth sub-driving signal and the sixth sub-driving signal is not limited here.

In some examples, as shown in FIG. 5, absolute values of effective voltages of the third sub-driving signal 013 and the fourth sub-driving signal 014 in the balance stage T2, the fifth sub-driving signal 015 and the sixth sub-driving signal 016 in the shaking stage T3, and the first sub-driving signal 011 and the second sub-driving signal 012 in the display stage T1 are all the same. For example, in the balance stage T2, the effective voltage of the third sub-driving signal 013 is +15V, and the effective voltage of the fourth sub-driving signal 014 is −15V. In the shaking stage T3, pulse signals of the fifth sub-driving signal 015 and the sixth sub-driving signal 016 have a positive voltage of +15V and a negative voltage of −15V. In the display stage T1, the effective voltage of the first sub-driving signal 011 is −15V and the effective voltage of the second sub-driving signal 012 is +15V.

In some examples, as shown in FIG. 5, in the shaking stage T3, the pulse signals of the fifth sub-driving signal 015 and the pulse signals of the sixth sub-driving signal 016 are the same. However, this is not limited in the present embodiment. For example, the pulse signals of the fifth sub-driving signal and the pulse signals of the sixth sub-driving signal may be opposite, that is, an application period of a positive voltage of the fifth sub-driving signal corresponds to an application period of a negative voltage of the sixth sub-driving signal, and an application period of a negative voltage of the fifth sub-driving signal corresponds to an application period of a positive voltage of the sixth sub-driving signal. Or, the application period of the negative voltage of the fifth sub-driving signal corresponds to an application period of a zero voltage of the sixth sub-driving signal, and an application period of a zero voltage of the fifth sub-driving signal corresponds to the application period of the positive voltage of the sixth sub-driving signal.

In the present exemplary embodiment, through the shaking stage, the black particles and the white particles in each microcapsule can be fully separated and uniformly mixed, which contributes to their swift and accurate movement in the display stage, thereby improving the display effect.

The implementation of the driving waveform in the balance stage and the display stage in the present exemplary embodiment may be referred to the description of the corresponding embodiment in FIG. 4, and will not be repeated here.

In some exemplary embodiments, a adjustment frequency adopted in the driving process of the electronic paper display apparatus may be, for example, 30 Hz to 35 Hz. By changing the adjustment frequency, waveform frequencies in the balance stage, the shaking stage and the display stage can be adjusted. Increasing the adjustment frequency can improve the display clarity, and the picture refresh time can be shortened, further improving the display effect.

In some exemplary embodiments, during an adjustment process of an electronic paper display apparatus, at a certain temperature section (e.g., normal temperature section), issues such as mura, font blur, and afterimage may be observed by human eyes according to the detection specification. After confirming that the electronic paper display apparatus has no issues such as mura, font blur, and afterimage, a problem of whitening of display of the black-and-white particle image can be detected. Once a problem of whitening of display of the black-and-white particle image is observed, the processor of the electronic paper display apparatus may adopt the driving method provided in the present embodiment to drive the electronic paper display apparatus to display a black-and-white particle image. After normal display of the black-and-white particle image is confirmed by human eyes, the electronic paper display apparatus can be adjusted in a next temperature section (for example, high temperature section) with reference to a detection mode of the current temperature section.

At least one embodiment of the present disclosure further provides a method for driving an electronic paper display apparatus. The electronic paper display apparatus includes: multiple microcapsules, and a first electrode and a second electrode disposed on opposite sides of at least one of the microcapsules. The at least one microcapsule includes black particles and white particles, wherein electric properties of charges carried by the black particles and electric properties of charges carried by the white particles are opposite. The driving method according to this embodiment includes: applying a first driving signal to a first electrode of a microcapsule to be displayed in white, and applying a second driving signal to a first electrode of a microcapsule to be displayed in black according to a black-and-white particle image to be displayed. The first driving signal includes a first sub-driving signal applied in a display stage, wherein the first sub-driving signal is configured to drive the white particles in the microcapsule to be displayed in white to be closer to a display side relative to the black particles. The second driving signal includes a second sub-driving signal applied in the display stage, wherein the second sub-driving signal is configured to drive the black particles in the microcapsule to be displayed in black to be closer to the display side relative to the white particles. An effective voltage of the first sub-driving signal and an effective voltage of the second sub-driving signal are alternately applied in sequence.

In some exemplary embodiments, the effective voltage of the first sub-driving signal and the effective voltage of the second sub-driving signal have a same absolute value and opposite electrical properties. For example, the first sub-driving signal is a negative voltage signal and the second sub-driving signal is a positive voltage signal. However, this is not limited in the present embodiment.

In some exemplary embodiments, the first sub-driving signal includes at least one first pulse unit. The second sub-driving signal includes at least one second pulse unit. The at least one first pulse unit corresponds to the at least one second pulse unit in one-to-one correspondence. The number of the first pulse units of the first sub-driving signal is consistent with the number of the second pulse units of the second sub-driving signal.

In some exemplary embodiments, each first pulse unit includes a first voltage and a first common voltage which are sequentially applied. Each second pulse unit includes a second voltage and a second common voltage which are sequentially applied, wherein the first voltage and the second voltage have opposite electrical properties. The first voltage is equal to the effective voltage of the first sub-driving signal, and the second voltage is equal to the effective voltage of the second sub-driving signal. The first voltage and the second common voltage have a same application duration, and the first common voltage and the second voltage have a same application duration. For example, the first voltage is a negative voltage and the second voltage is a positive voltage. However, this is not limited in the present embodiment.

In some exemplary embodiments, the first voltage and the second voltage have a same application duration. However, this is not limited in the present embodiment. For example, the application duration of the first voltage and the application duration of the second voltage may be different.

In some exemplary embodiments, the first sub-driving signal includes N first pulse units, and the second sub-driving signal includes N second pulse units, wherein N is an integer greater than 1. An end moment of the first voltage of the n-th first pulse unit is a start moment of the second voltage of a corresponding n-th second pulse unit, and an end moment of the second voltage of the n-th second pulse unit a the start moment of the first voltage of the (n+1)-th first pulse unit, wherein n is an integer greater than 0 and less than N. However, this is not limited in the present embodiment. For example, zero voltage may be applied for a period of time during the alternation of the first pulse units and the second pulse units.

In some exemplary embodiments, the first driving signal further includes a third sub-driving signal applied in a balance stage before a display stage, and the second driving signal further includes a fourth sub-driving signal applied in the balance stage before the display stage. An product of an absolute value of an effective voltage of the third sub-driving signal and an application duration thereof is equal to a product of an absolute value of an effective voltage of a fourth sub-driving signal and an application duration thereof. The effective voltage of the third sub-driving signal and the effective voltage of the fourth sub-driving signal have a same absolute value and opposite electrical properties.

In some exemplary embodiments, the effective voltage of the third sub-driving signal and an effective voltage of the first sub-driving signal have opposite electrical properties. The effective voltage of the fourth sub-driving signal and an effective voltage of the second sub-driving signal have opposite electrical properties.

In some exemplary embodiments, the first driving signal further includes a fifth sub-driving signal applied in a shaking stage between a display stage and a balance stage. The second driving signal further includes a sixth sub-driving signal applied in the shaking stage between the display stage and the balance stage. The fifth sub-driving signal and the sixth sub-driving signal each include pulse signals with alternating positive and negative voltages.

In some exemplary embodiments, absolute values of effective voltages of the first sub-driving signal, the second sub-driving signal, the third sub-driving signal, the fourth sub-driving signal, the fifth sub-driving signal and the sixth sub-driving signal are all the same. In other words, heights of the driving waveforms in the balance stage, the shaking stage and the display stage according to the present exemplary embodiment are the same.

Relevant implementations of the driving method according to the present embodiment can be referred to the description of the aforementioned embodiment and will not be repeated here.

At least one embodiment of the present disclosure further provides a non-transitory computer-readable storage medium on which a computer program is stored. When the program is executed by a processor, the method for driving the electronic paper display apparatus provided in any of the aforementioned embodiments is implemented.

Those of ordinary skill in the art may understand that all or some of the steps in the method, the system, and functional modules/units in the apparatus disclosed above may be implemented as software, firmware, hardware, and an appropriate combination thereof. In a hardware implementation, the division between functional modules/units mentioned in the above description does not necessarily correspond to the division of physical components. For example, a physical component may have multiple functions, or a function or a step may be performed by several physical components in cooperation. Some or all of the components may be implemented as software executed by a processor, such as a digital signal processor or a microprocessor, or as hardware, or as an integrated circuit, such as an application specific integrated circuit. Such software may be distributed on a computer readable medium, which may include a computer storage medium (or a non-transitory medium) and a communication medium (or a transitory medium). As is well known to those of ordinary skill in the art, the term "computer storage medium" includes volatile and nonvolatile, removable and non-removable media implemented in any method or technology for storing information (such as computer readable instructions, a data structure, a program module or other data). Computer storage media include, but are not limited to, random access memories (RAMs), read only memories (ROMs), electrically erasable programmable ROMs (EEPROMs), flash memories or other memory technologies, compact disc-ROMs (CD-ROMs), Digital Versatile Disks (DVDs) or other optical disk storage, magnetic cassettes, magnetic tapes, magnetic disk storage or other magnetic storage devices, or any other media that may be used to store desired information and may be accessed by a computer. Furthermore, it is well known to those of ordinary skill in the art that the communication medium typically contains computer readable instructions, a data structure, a program module, or other data in a modulated data signal such as a carrier or another transmission mechanism, or the like, and may include any information delivery medium.

Although the embodiments disclosed in the present disclosure are as described above, the described contents are only the embodiments for facilitating understanding of the present disclosure, which are not intended to limit the present disclosure. Any person skilled in the art to which the present disclosure pertains may make any modifications and variations in the form and details of implementation without departing from the essence and scope of the present disclosure. Nevertheless, the scope of patent protection of the present disclosure shall still be determined by the scope defined by the appended claims.

What is claimed is:

1. A method for driving an electronic paper display apparatus, wherein the electronic paper display apparatus comprises: a plurality of microcapsules, and a first electrode and a second electrode disposed on opposite sides of at least one microcapsule among the plurality of microcapsules; the at least one microcapsule comprises black particles and white particles, wherein an electric property of charges carried by the black particles and an electric property of charges carried by the white particles are opposite;

the driving method comprises:

applying a first driving signal to a first electrode of a microcapsule to be displayed in white, and applying a second driving signal to a first electrode of a microcapsule to be displayed in black according to a black-and-white particle image to be displayed;

wherein the first driving signal comprises a first sub-driving signal applied in a display stage, and the first sub-driving signal is configured to drive the white particles in the microcapsule to be displayed in white to be closer to a display side relative to the black particles;

the second driving signal comprises a second sub-driving signal applied in the display stage, and the second sub-driving signal is configured to drive the black particles in the microcapsule to be displayed in black to be closer to the display side relative to the white particles; and an effective voltage of the first sub-driving signal and an effective voltage of the second sub-driving signal are alternately applied in sequence;

wherein the first sub-driving signal comprises at least one first pulse unit, and the second sub-driving signal comprises at least one second pulse unit;

wherein the at least one first pulse unit and the at least one second pulse unit are in one-to-one correspondence;

wherein each first pulse unit comprises a first voltage and a first common voltage which are sequentially applied; each second pulse unit comprises a second voltage and a second common voltage which are sequentially applied; the first voltage and the second voltage have opposite electrical properties; the first voltage is equal to the effective voltage of the first sub-driving signal, and the second voltage is equal to the effective voltage of the second sub-driving signal; and the first voltage has a same application duration of as the second common voltage, and the first common voltage has a same application duration as the second voltage.

2. The driving method according to claim 1, wherein the effective voltage of the first sub-driving signal and the effective voltage of the second sub-driving signal have a same absolute value and opposite electrical properties.

3. The driving method according to claim 1, wherein the first voltage has a same application duration as the second voltage.

4. The driving method according to claim 1, wherein the first sub-driving signal comprises N first pulse units, and the second sub-driving signal comprises N second pulse units, wherein N is an integer greater than 1;

an end moment of a first voltage of a n-th first pulse unit is a start moment of a second voltage of a corresponding n-th second pulse unit, and an end moment of the second voltage of the n-th second pulse unit is a start moment of a first voltage of a (n+1)-th first pulse unit, wherein n is an integer greater than 0 and less than N.

5. The driving method according to claim 1, wherein the first driving signal further comprises a third sub-driving signal applied in a balance stage before the display stage;

the second driving signal further comprises a fourth sub-driving signal applied in the balance stage before the display stage;

a product of an absolute value of an effective voltage of the third sub-driving signal and an application duration of the third sub-driving signal is equal to a product of an absolute value of an effective voltage of the fourth sub-driving signal and an application duration of the fourth sub-driving signal; and the effective voltage of the third sub-driving signal and the effective voltage of the fourth sub-driving signal have the same absolute value and opposite electrical properties.

6. The driving method according to claim 5, wherein the effective voltage of the third sub-driving signal and an effective voltage of the first sub-driving signal have opposite electrical properties; and the effective voltage of the fourth sub-driving signal and an effective voltage of the second sub-driving signal have opposite electrical properties.

7. The driving method according to claim 6, wherein the first driving signal further comprises a fifth sub-driving signal applied in a shaking stage between the display stage and the balance stage; and the second driving signal further comprises a sixth sub-driving signal applied in the shaking stage between the display stage and the balance stage;

wherein the fifth sub-driving signal and the sixth sub-driving signal each comprise pulse signals with alternating positive and negative voltages.

8. The driving method according to claim 7, wherein absolute values of effective voltages of the first sub-driving signal, the second sub-driving signal, the third sub-driving signal, the fourth sub-driving signal, the fifth sub-driving signal and the sixth sub-driving signal are all the same.

9. A non-transitory computer readable storage medium on which a computer program is stored, wherein the driving method according to claim 1 is implemented when the computer program is executed by a processor.

10. An electronic paper display apparatus, comprising: a plurality of microcapsules, and a first electrode and a second electrode disposed on opposite sides of at least one microcapsule among the plurality of microcapsules; the at least one microcapsule comprises black particles and white particles, wherein an electric property of charges carried by the black particles and an electric property of charges carried by the white particles are opposite;

the electronic paper display apparatus further comprises a processor, which is configured to execute a driving method, and the driving method comprises:

applying a first driving signal to a first electrode of a microcapsule to be displayed in white, and applying a second driving signal to a first electrode of a microcapsule to be displayed in black according to a black-and-white particle image to be displayed;

the first driving signal comprises a first sub-driving signal applied in a display stage, wherein the first sub-driving signal is configured to drive the white particles in the microcapsule to be displayed in white to be closer to a display side relative to the black particles;

the second driving signal comprises a second sub-driving signal applied in the display stage, wherein the second sub-driving signal is configured to drive the black particles in the microcapsule to be displayed in black to be closer to the display side relative to the white particles; and an effective voltage of the first sub-driving signal and an effective voltage of the second sub-driving signal are alternately applied in sequence;

wherein the first sub-driving signal comprises at least one first pulse unit, and the second sub-driving signal comprises at least one second pulse unit;

wherein the at least one first pulse unit and the at least one second pulse unit are in one-to-one correspondence;

wherein each first pulse unit comprises a first voltage and a first common voltage which are sequentially applied; each second pulse unit comprises a second voltage and a second common voltage which are sequentially applied; the first voltage and the second voltage have opposite electrical properties; the first voltage is equal to the effective voltage of the first sub-driving signal, and the second voltage is equal to the effective voltage of the second sub-driving signal; and the first voltage has a same application duration of as the second common voltage, and the first common voltage has a same application duration as the second voltage.

11. The electronic paper display apparatus according to claim 10, wherein the effective voltage of the first sub-driving signal and the effective voltage of the second sub-driving signal have a same absolute value and opposite electrical properties.

12. The electronic paper display apparatus according to claim 10, wherein the first voltage has same application duration as the second voltage.

13. The electronic paper display apparatus according to claim 10, wherein the first sub-driving signal comprises N first pulse units, and the second sub-driving signal comprises N second pulse units, wherein N is an integer greater than 1;

an end moment of a first voltage of a n-th first pulse unit is a start moment of a second voltage of a corresponding n-th second pulse unit, and an end moment of the second voltage of the n-th second pulse unit is a start moment of a first voltage of a (n+1)-th first pulse unit, wherein n is an integer greater than 0 and less than N.

14. The electronic paper display apparatus according to claim 10, wherein the first driving signal further comprises a third sub-driving signal applied in a balance stage before the display stage;

the second driving signal further comprises a fourth sub-driving signal applied in the balancing stage before the display stage;

a product of an absolute value of an effective voltage of the third sub-driving signal and an application duration of the third sub-driving signal is equal to a product of an absolute value of an effective voltage of the fourth sub-driving signal and an application duration of the third sub-driving signal; and the effective voltage of the third sub-driving signal and the effective voltage of the fourth sub-driving signal have a same absolute value and opposite electrical properties.

15. The electronic paper display apparatus according to claim 14, wherein the effective voltage of the third sub-driving signal and an effective voltage of the first sub-driving signal have opposite electrical properties; and the effective voltage of the fourth sub-driving signal and an effective voltage of the second sub-driving signal have opposite electrical properties.

16. The electronic paper display apparatus according to claim 15, wherein the first driving signal further comprises a fifth sub-driving signal applied in a shaking stage between the display stage and the balance stage;

the second driving signal further comprises a sixth sub-driving signal applied in the shaking stage between the display stage and the balance stage; and the fifth sub-driving signal and the sixth sub-driving signal each comprise pulse signals with alternating positive and negative voltages;

wherein absolute values of effective voltages of the first sub-driving signal, the second sub-driving signal, the third sub-driving signal, the fourth sub-driving signal, the fifth sub-driving signal and the sixth sub-driving signal are all the same.

* * * * *